US005611963A

United States Patent [19]

Unger

[11] Patent Number: 5,611,963

[45] Date of Patent: Mar. 18, 1997

[54] METHOD OF REDUCING HALIDES IN SYNTHESIS GAS

[75] Inventor: Phillip E. Unger, Houston, Tex.

[73] Assignee: Shell Oil Company, Houston, Tex.

[21] Appl. No.: 295,186

[22] Filed: Aug. 24, 1994

Related U.S. Application Data

[63] Continuation-in-part of Ser. No. 46,355, Apr. 8, 1993, abandoned.

[51] Int. Cl.[6] ..... B01D 53/68; C01B 3/50; C01B 3/34

[52] U.S. Cl. ..... 252/373; 423/240 R; 423/240 S; 48/197 R; 48/210

[58] Field of Search ..... 423/240 R, 240 S, 423/200; 588/244; 48/197 R, 210; 252/373

[56] References Cited

U.S. PATENT DOCUMENTS

| | | | |
|---|---|---|---|
| 3,759,036 | 9/1973 | White | 65/39.05 |
| 3,890,432 | 7/1975 | White | 423/437 |
| 3,977,844 | 8/1976 | Van Slyke . | |
| 4,017,271 | 4/1977 | Barclay et al. . | |
| 4,265,868 | 5/1981 | Kamody | 48/197 R |
| 4,277,365 | 7/1981 | Paull et al. | 48/197 R |
| 4,378,974 | 4/1983 | Petit et al. | 48/197 R |
| 4,423,702 | 1/1984 | Ashworth et al. | 48/210 |
| 4,776,860 | 10/1988 | Najjar et al. | 48/197 R |
| 4,859,213 | 8/1989 | Segerstrom | 48/87 |
| 5,118,480 | 6/1992 | Cook et al. . | |
| 5,133,780 | 7/1992 | Sadowski | 48/87 |

FOREIGN PATENT DOCUMENTS

| | | |
|---|---|---|
| 1140759 | 2/1983 | Canada . |
| 3332913A1 | 6/1993 | Germany . |
| 55-120690 | 9/1980 | Japan . |

OTHER PUBLICATIONS

David A. Fox and Alfred H. White, "Effect of Sodium Carbonate Upon Gasification of Carbon and Production of Producer Gas," *Industrial and Engineering Chemistry*, vol. 23, No. 3, pp. 259–266.

*Primary Examiner*—Michael Lewis
*Assistant Examiner*—Peter DiMauro

[57] ABSTRACT

The invention is a method for reducing halide content of a synthesis gas stream by mixing a metal compound of potassium oxide, potassium hydroxide, potassium bicarbonate, potassium carbonate, sodium oxide, sodium hydroxide, sodium bicarbonate, or sodium carbonate, with a carbonaceous feed material which contains halide-containing compounds; gasifying the carbonaceous feed material in an entrained flow gasifier under gasifying conditions thus producing a synthesis gas containing hydrogen and carbon monoxide; where the metal compound vaporizes and the vaporized metal compound reacts with the halide from the halide-containing compounds, thus producing a vaporized metal halide; cooling the vaporized metal halide, thus producing solid metal halide particles; passing the synthesis gas stream to a solids removal unit for removing the solid metal halide particles; and recovering the synthesis gas stream substantially free of halide-containing compounds.

14 Claims, No Drawings

METHOD OF REDUCING HALIDES IN SYNTHESIS GAS

This is a continuation-in-part, of application Ser. No. 08/046,355, filed Apr. 8, 1993, now abandoned.

I. FIELD OF THE INVENTION

The invention relates to a method for reducing halide content of a synthesis gas stream.

II. BACKGROUND OF THE INVENTION

The combustion of a carbonaceous material such as a solid carbonaceous fuel by reaction with a source of gaseous oxygen is well known. In such a reaction, an amount of air or oxygen equal to or greater than that required for complete combustion is used, whereby the gaseous effluent contains carbon dioxide with little, if any, carbon monoxide. It is also known to carry out the gasification or partial oxidation of solid carbonaceous materials or fuels employing a limited quantity of oxygen or air so as to produce primarily carbon monoxide and hydrogen.

Fuel sources, particularly coals, often have an undesirable halide content. The halogens in halides, such as chlorine in chlorides, form acids in the synthesis gas mixture which can cause severe corrosion in the downstream processing equipment. They also pose environmental and safety hazards if emitted to the atmosphere.

Another problem caused by the halides is reduced efficiency of the process. Formation of some salts in the synthesis gas during processing limits the overall efficiency of the heat recovery from the synthesis gas. This occurs because some salts, such as ammonium chloride, are very corrosive when permitted to condense. Thus, to avoid having the salts condense the synthesis gas cannot be cooled below the sublimation points of various salts. Since the temperature to which the synthesis gas may be cooled is thus limited, the heat recovery from the gas is accordingly limited. Chlorine-containing salts are formed due to the presence of HCl. By removing HCl from the synthesis gas, formation of such salts in the gas stream is reduced or eliminated and the gas can be cooled further to permit more thermal recovery.

A prior known method of removing HCl is by a wet absorption system. In that method the synthesis gas must be cooled and passed through an aqueous absorption column. The HCl is absorbed in the water and neutralized with NaOH. This method has drawbacks since cooling the gas to remove the HCl is inefficient and results in heat/energy loss. Additional equipment and maintenance costs also result from the addition of an absorption column to the process. Economic drawbacks also result from the need for a large water treatment plant due to build up of salts in the water from the absorption column.

It is known from U.S. Pat. No. 5,118,480 to add metals such as Nahcolite to a synthesis gas downstream of the gasifier to remove HCl in conjunction with removing sulfur with a metal oxide sorbent. However, this process lacks the benefits obtained from adding the metal compound to the feed in the gasifier or before the gasifier. The salt formation reaction is believed to benefit from the dissociation and vaporization of the halide and metal compounds in the high temperatures of the gasifier.

It would be advantageous to have a practical and efficient dry method of removing the halides.

III. SUMMARY OF THE INVENTION

The invention is a method for reducing halide content of a synthesis gas stream including:

(a) mixing a metal compound free of metal halides selected from the group consisting of potassium oxide, potassium hydroxide, potassium bicarbonate, potassium carbonate, sodium oxide, sodium hydroxide, sodium bicarbonate, sodium carbonate, and mixtures thereof with a carbonaceous feed material, which contains halide-containing compounds;

(b) gasifying the carbonaceous feed material in the resulting mixture in an entrained flow gasifier under gasifying conditions thereby producing a gas comprising hydrogen and carbon monoxide;

(c) where the metal compound substantially vaporizes and the vaporized metal compound reacts with the halide from the halide-containing compounds, thereby producing a vaporized metal halide and wherein said vaporized metal compound does not substantially form metal sulfides;

(d) cooling the vaporized metal halide, thereby producing solid metal halide particles;

(e) removing the solid metal halide particles in the gas stream substantially free of metal sulfides formed by reaction with said metal compound, in a solids removal unit and wherein said metal compound does not substantially react to form metal sulfides; and (f) recovering the gas stream substantially free of halide-containing compounds.

IV. DETAILED DESCRIPTION OF THE EMBODIMENTS

A. Feeds and Metal Compounds and Mixture Thereof

Several types of carbonaceous materials are suitable for feed sources. These include bituminous coal, anthracite coal, lignite, liquid hydrocarbons, petroleum coke, various organic scrap materials, municipal refuse, solid organic refuse contaminated with radioactive materials, paper industry refuse, and photographic scrap. Coal and petroleum coke are preferred feeds in this invention.

The metal compounds are free or substantially free of metal halides and are those which will vaporize at the gasifier temperatures and will react with the halide present in the carbonaceous material to form a metal halide. These include potassium oxide, potassium hydroxide, potassium bicarbonate, potassium carbonate, sodium oxide, sodium hydroxide, sodium bicarbonate, and sodium carbonate. Nahcolite, a naturally occurring form of sodium bicarbonate, is preferred for its economy and availability. The metal compounds are optionally used individually or in combination.

The carbonaceous feed and the metal compounds are mixed either in the gasifier or upstream of the gasifier. A particularly efficient method of mixing is to pulverize, in the case of solid feed, both the feed and the metal compound together in the pulverizer. Either, or both, the carbonaceous feed or the metal compound are fed to the gasifier either dry or in a water slurry. If the metal compound is not mixed with the feed prior to introducing the feed into the gasifier, then it is pulverized separately from the feed and is injected independently of the feed into the gasifier. In independent injection of the metal compound, it is either transported pneumatically in nitrogen or carbon dioxide or is carried in a water slurry.

B. Reaction, Cooling, and Solids Removal

In the gasifier the carbonaceous material partially oxidizes to form synthesis gas which is primarily carbon monoxide and hydrogen. In the gasifier a substantial amount of the metal compound introduced into the gasifier is vaporized. The vaporized metal compound reacts with the halide from the halide-containing compounds from the carbonaceous materials. Metal halides are therefore formed. For example, where the metal compound is sodium bicarbonate, sodium chloride is formed. The resulting metal chloride remains in a vapor form until cooled below its sublimation point. The metal compound does not substantially react with any sulfur in the feed to form metal sulfides. This is because at the high temperatures needed to vaporize the metal compounds, reaction of the metal compounds with sulfur is not favored. Thus, this process is not used to contemperaneously form metal halides and metal sulfides in the gasifier.

The synthesis gas and vaporized metal halides are then passed from the gasifier to one or more quenching and/or cooling stages. As a result of the cooling the vaporized metal halides condense to solid particles. The synthesis gas stream containing the solid metal halide particles is passed to one or more solids removal stages. The solids removal stage is preferably a cyclone or ceramic candle filter, used individually or in combination. In the solids removal stage removes the solid metal halide particles which are substantially-free of metal sulfides formed by reaction with said metal compound. That is, substantially the only metal sulfides removed with the metal halides are any naturally ocurring metal sulfides in the feed. An electrostatic precipitator is optionally used where the system pressure is at or near atmospheric. The synthesis gas recovered from the solids separation stage has reduced amounts of halides and is preferably substantially free of halides.

C. Concentrations of Hal ides, Ratios, and Percent Removal

The initial concentration of halides in the feed material varies widely with the type and source of the feed. Chlorine concentrations in coal range from about 0.01 % wt. to about 0.35 % wt. Other halide concentrations in coal are typically much lower than chlorine concentrations. However, even in low concentrations some halides, such as hydrogen fluoride, are very corrosive.

At least a stoichiometric amount of metal compounds must be mixed with the feed with respect to the halide concentration in the feed. Preferably, one to three times the stoichiometric ratio is used of metal compounds to halides. This assures a high degree of removal of the halides. More than about three times the stoichiometric ratio is wasteful of metal compounds and makes the process uneconomical without any apparent benefit.

From about 95 % wt. to about 99 % wt. of the halides are removed in the practice of this method. For example, the synthesis gas will contain from about 10 ppm by volume (ppmv) to about 1000 ppmv chlorine where the feed is coal. After gasification and reaction and solids removal of the metal halides, the concentration of chlorine is from about 0.1 ppmv to about 5 ppmv.

D. Operation Conditions

The gasifier is operated at gasifying conditions. These conditions may vary from feed to feed. The temperature is a temperature high enough to vaporize a substantial portion of the alkali metal compound. Vaporization of the metal compound is necessary for the metal compound to react with the halides to form metal halides. Typical temperatures in the gasifier are from about 1100° C. (2000° F.) to about 2000° C. (3600° F.). Where the feed is coal, the gasifier temperature is preferably from about 1480° C. (2700° F.) to about 1760° C. (3200° F.). The pressure of the gasifier is greater than about 300 psig and preferably from about 350 psig to about 370 psig.

What is claimed is:

1. A method for reducing halide content of a gas consisting essentially of:

(a) admixing a substantially halide-free metal compound selected from the group consisting of potassium oxide, potassium hydroxide, potassium bicarbonate, potassium carbonate, sodium oxide, sodium hydroxide, sodium bicarbonate, sodium carbonate, and mixtures thereof with coal wherein said coal contains halide-containing compounds, and wherein the amount of metal compound admixed with the coal is 1 to about 3 times the stoichiometric amount of metal compound necessary to form metal halide with respect to the halide content of the coal;

(b) gasifying the coal in the resulting mixture in an entrained flow gasifier under gasifying conditions at a temperature from about 1480° C. to about 1760° C. thereby producing a synthesis gas comprising hydrogen and carbon monoxide, wherein the metal compound in the mixture vaporizes;

(c) reacting the vaporized metal compound with the halide from the halide-containing compounds, thereby producing a vaporized metal halide, wherein said vaporized metal compound does not substantially react to form metal sulfides, and wherein said vaporized metal halide is carried with said synthesis gas;

(d) sufficiently cooling the vaporized metal halide downstream from said gasifier to produce solid metal halide particles contained within the synthesis gas stream;

(e) removing the solid metal halide particles from the gas in a solids removal unit, wherein said solid metal halide particles are substantially-free of metal sulfides formed by reaction with said vaporized metal compound, and wherein the gas exiting said solids removal unit is substantially free of halide-containing compounds; and (f) recovering the gas.

2. The method according to claim 1 wherein the amount of metal compounds admixed with the coal is at least a stoichiometric amount of metal compounds with respect to the halide content of the coal.

3. The method according to claim 1 further comprising a coal pulverizing stage upstream of the gasifier and wherein the metal compound is admixed with the coal at the pulverizing stage.

4. The method according to claim 1 further comprising a coal pulverizing stage and wherein the metal compound is admixed with the coal after the pulverizing stage.

5. The method according to claim 2 wherein the metal compound is sodium bicarbonate and is dry at the point of admixture with the coal.

6. A method for reducing halide content of a synthesis gas stream consisting essentially of:

(a) admixing one halide-free metal compound selected from the group consisting of potassium oxide, potassium hydroxide, potassium bicarbonate, potassium carbonate, sodium oxide, sodium hydroxide, sodium bicarbonate, and sodium carbonate with a carbonaceous feed material selected from the group consisting of coal, petroleum coke, liquid hydrocarbons, and mixtures thereof, wherein said carbonaceous feed material contains halide-containing compounds, and wherein the amount of metal compound admixed with the feed is 1 to about 3 times the stoichiometric amount of metal compound necessary to form metal halide with respect to the halide content of the feed;

(b) feeding the resulting mixture into an entrained flow gasifier under gasifying conditions at a temperature in the gasifier from about 1480° C. to about 1760° C. thereby producing a synthesis gas comprising hydrogen and carbon monoxide, wherein the metal compound in the mixture substantially vaporizes;

(c) reacting the vaporized metal compound with the halide from the halide-containing compounds, thereby producing a vaporized metal halide, wherein said vaporized metal compound does not substantially react to form metal sulfides, wherein said vaporized metal halide is carried with said synthesis gas;

(d) sufficiently cooling the vaporized metal halide downstream from said gasifier to produce solid metal halide particles contained within the synthesis gas stream;

(e) passing the synthesis gas stream to a solids removal unit for removing the solid metal halide particles, said solid metal halide particles being substantially-free of metal sulfides formed by reaction with said vaporized metal compound, wherein the synthesis gas stream exiting said solids removal unit is substantially free of halide-containing compounds; and (f) recovering the synthesis gas stream.

7. The method according to claim 6 wherein the pressure in the gasifier is greater than about 300 psig.

8. The method according to claim 6 wherein the pressure in the gasifier is from about 350 psig to about 370 psig.

9. The method according to claim 6 wherein the carbonaceous material is coal, the metal compound is sodium bicarbonate, and the halide is chloride, and wherein prior to admixing the coal with the sodium bicarbonate the coal contains from about 0.01% by weight to about 0.35% by weight chlorine based on the coal and wherein from about 95% by weight to about 99% by weight of the chlorine is removed, said removed chlorine being recovered in the form of sodium chloride in the solids removal unit.

10. The method according to claim 9 wherein prior to the reaction of the sodium bicarbonate with the chlorine in the gasifier the synthesis gas contains from about 10 ppmv to about 1000 ppmv chlorine based on the synthesis gas and after the solids removal unit the synthesis gas contains from about 0.1 ppmv to about 5 ppmv of the chlorine based on the synthesis gas.

11. The method of claim 6 wherein the carbonaceous feed comprises petroleum coke.

12. A method for reducing halide content of a synthesis gas stream consisting essentially of:

(a) mixing in an entrained flow gasifier under gasifying conditions at a temperature in the gasifier from about 1480° C. to about 1760° C. one halide-free metal compound selected from the group consisting of potassium oxide, potassium hydroxide, potassium bicarbonate, potassium carbonate, sodium oxide, sodium hydroxide, sodium bicarbonate, and sodium carbonate with a carbonaceous feed material selected from the group consisting of coal, petroleum coke, liquid hydrocarbons, and mixtures thereof containing halide-containing compounds, thereby producing a synthesis gas comprising hydrogen and carbon monoxide, wherein the amount of metal compound admixed with the feed is 1 to about 3 times the stoichiometric amount of metal compound necessary to form metal halide with respect to the halide content of the feed, and wherein the metal compound substantially vaporizes;

(b) reacting the vaporized metal compound with the halide from the halide-containing compounds, thereby producing a vaporized metal halide, wherein said vaporized metal compound does not substantially react to form metal sulfides, wherein said vaporized metal halide is carried with said synthesis gas;

(c) sufficiently cooling the vaporized metal halide downstream from said gasifier to produce solid metal halide particles contained within the synthesis gas stream;

(d) passing the synthesis gas stream to a solids removal unit for removing the solid metal halide particles, said solid metal halides being substantially-free of metal sulfides formed by reaction with said vaporized metal compound, wherein the synthesis gas stream exiting said solids removal unit is substantially free of halide-containing compounds; and (e) recovering the synthesis gas stream.

13. The method according to claim 12 wherein the pressure in the gasifier is greater than about 300 psig.

14. The method according to claim 13 wherein the carbonaceous feed material is coal, and wherein the metal compound is sodium bicarbonate and is dry at the point of admixture with the coal.

* * * * *